US009903582B2

(12) United States Patent
Kizele et al.

(10) Patent No.: US 9,903,582 B2
(45) Date of Patent: Feb. 27, 2018

(54) LIGHTING UNIT FOR A HOUSEHOLD APPLIANCE

(71) Applicant: Marquardt Mechatronik GmbH, Rietheim-Weilheim (DE)

(72) Inventors: Rainer Kizele, Tuttlingen (DE); Heinrich Müller, Tuttlingen (DE); Wolfgang Moosmann, Wolfach (DE); Björn Werhan, Blumberg (DE)

(73) Assignee: Marquardt Mechatronik GmbH, Rietheim-Weilheim (DE)

( * ) Notice: Subject to any disclaimer, the term of this patent is extended or adjusted under 35 U.S.C. 154(b) by 0 days.

(21) Appl. No.: 14/081,169

(22) Filed: Nov. 15, 2013

(65) Prior Publication Data

US 2014/0140073 A1 May 22, 2014

Related U.S. Application Data

(63) Continuation of application No. PCT/EP2012/002114, filed on May 16, 2012.

(30) Foreign Application Priority Data

May 19, 2011 (DE) ..... 10 2011 102 078

(51) Int. Cl.
*F21V 33/00* (2006.01)
*F21V 29/00* (2015.01)
(Continued)

(52) U.S. Cl.
CPC ..... *F21V 33/0044* (2013.01); *F21V 19/003* (2013.01); *F21V 19/0005* (2013.01);
(Continued)

(58) Field of Classification Search
CPC ..... F21V 33/0044; F21V 19/0025; F21V 19/004; F21V 19/0045; F21V 29/004; F21V 29/70
(Continued)

(56) References Cited

U.S. PATENT DOCUMENTS 4,899,264 A * 2/1990 Ries et al. ..... 362/92
5,869,932 A * 2/1999 Choi ..... D06F 39/12 315/76
(Continued)

FOREIGN PATENT DOCUMENTS

CN 1644978 A 7/2005
CN 101548436 A 9/2009
(Continued)

OTHER PUBLICATIONS

EP 1048775 Espacenet machine translation.*
(Continued)

*Primary Examiner* — Jong-Suk (James) Lee
*Assistant Examiner* — Colin Cattanach
(74) *Attorney, Agent, or Firm* — Burr & Brown, PLLC

(57) ABSTRACT

A lighting unit for a household appliance, the lighting unit has a printed circuit board having a light-emitting means arranged on the printed circuit board, and a base for receiving the printed circuit board. The printed circuit board is arranged on a metallic holding part such that good thermally conductive contact is provided between the printed circuit board and the holding part, and the holding part is fastened on the base in such a way that good heat transfer is provided from the holding part to the base.

16 Claims, 3 Drawing Sheets

(51) Int. Cl.

| | |
|---|---|
| ***F21V 19/00*** | (2006.01) |
| ***F21V 29/71*** | (2015.01) |
| ***F21V 23/06*** | (2006.01) |
| ***F21V 29/70*** | (2015.01) |
| *F21S 8/10* | (2006.01) |
| *D06F 39/00* | (2006.01) |
| *D06F 58/04* | (2006.01) |
| *F21Y 115/10* | (2016.01) |

(52) U.S. Cl.
CPC ..... *F21V 19/0025* (2013.01); *F21V 19/0045* (2013.01); *F21V 23/06* (2013.01); *F21V 29/70* (2015.01); *F21V 29/71* (2015.01); *D06F 39/00* (2013.01); *D06F 58/04* (2013.01); *F21S 48/1109* (2013.01); *F21S 48/1122* (2013.01); *F21V 19/004* (2013.01); *F21Y 2115/10* (2016.08)

(58) Field of Classification Search
USPC ..... 362/89, 91
See application file for complete search history.

(56) References Cited

U.S. PATENT DOCUMENTS

| | | | | |
|---|---|---|---|---|
| 6,036,241 | A * | 3/2000 | Ostdiek et al. | 292/229 |
| 6,848,819 | B1 * | 2/2005 | Arndt | F21S 48/328 362/373 |
| 7,621,752 | B2 * | 11/2009 | Lin | F21V 19/0015 439/56 |
| 8,016,444 | B2 * | 9/2011 | Cho | D06F 37/266 362/89 |
| 9,074,760 | B2 * | 7/2015 | Dal Ben | D06F 39/002 |
| 2001/0007526 | A1 * | 7/2001 | Ohkohdo | B60Q 1/2696 362/249.01 |
| 2003/0189829 | A1 * | 10/2003 | Shimizu | F21L 4/00 362/240 |
| 2005/0007791 | A1 * | 1/2005 | Helbach et al. | 362/555 |
| 2005/0174791 | A1 * | 8/2005 | Bynum | 362/490 |
| 2005/0180157 | A1 | 8/2005 | Watanabe et al. | |
| 2006/0141851 | A1 * | 6/2006 | Matsui | F21K 9/00 439/490 |
| 2007/0109806 | A1 * | 5/2007 | Tsukamoto | F21S 48/1109 362/545 |
| 2007/0177401 | A1 * | 8/2007 | Nakabayashi | 362/548 |
| 2007/0274086 | A1 * | 11/2007 | Takeda et al. | 362/507 |
| 2008/0053161 | A1 * | 3/2008 | Dahlke et al. | 68/13 R |
| 2008/0130275 | A1 * | 6/2008 | Higley | F21L 4/027 362/184 |
| 2008/0310167 | A1 * | 12/2008 | Zaderej | H05K 3/301 362/294 |
| 2009/0153057 | A1 * | 6/2009 | Cho et al. | 315/76 |
| 2010/0044745 | A1 * | 2/2010 | Sakai et al. | 257/99 |
| 2010/0091494 | A1 * | 4/2010 | Pearson et al. | 362/249.02 |
| 2010/0214799 | A1 * | 8/2010 | Ohmi | B60Q 1/2696 362/545 |
| 2011/0096045 | A1 * | 4/2011 | Ito | G09F 9/33 345/204 |
| 2011/0164407 | A1 * | 7/2011 | Stack et al. | 362/125 |
| 2012/0120667 | A1 | 5/2012 | Schenkl | |
| 2013/0314897 | A1 * | 11/2013 | Dal Ben et al. | 362/91 |

FOREIGN PATENT DOCUMENTS

| | | | | |
|---|---|---|---|---|
| DE | 10 2009 002 775 | A1 | 11/2010 | |
| DE | 10 2009 034 841 | A1 | 2/2011 | |
| EP | 1 048 775 | A1 | 11/2000 | |
| EP | 1048775 | * | 4/2003 | D06F 37/26 |
| EP | 10 2004 062 583 | A1 | 7/2006 | |
| EP | 1 918 448 | A1 | 5/2008 | |
| EP | 1918448 | * | 3/2011 | D06F 37/26 |
| EP | 2458059 | A1 * | 5/2012 | D06F 39/00 |
| JP | WO 2013168253 | A1 * | 11/2013 | F21V 5/04 |
| TW | 200425542 | A | 11/2004 | |
| WO | 2007/021082 | A2 | 2/2007 | |

OTHER PUBLICATIONS

Machine Translation of WO2013168253A1 retrieved from Google Patents.*

European Office Action (Application No. 12723112.4) dated Jan. 30, 2015.

German Search Report (Application No. 10 2011 102 078.4) dated Mar. 1, 2012.

International Search Report and Written Opinion (Application No. PCT/EP2012/002114) dated Aug. 21, 2012.

Chinese Office Action (With English Translation), Chinese Application No. 201280024269.2, dated Dec. 31, 2015 (11 pages).

Chinese Office Action (Application No. 201280024269.2) dated Nov. 11, 2016 (with English translation).

Chinese Office Action (with English Translation), Chinese Application No. 201280024269.2, dated Jun. 14, 2017 (7 pages).

* cited by examiner

LIGHTING UNIT FOR A HOUSEHOLD APPLIANCE

CROSS REFERENCE TO RELATED APPLICATIONS

This application is a continuation of International Application No. PCT/EP2012/002114 filed May 16, 2012, which designated the United States, and claims the benefit under 35 USC § 119(a)-(d) of German Application No. 10 2011 102 078.4 filed May 19, 2011, the entireties of which are incorporated herein by reference.

FIELD OF THE INVENTION

The invention relates to a lighting unit for a household appliance.

BACKGROUND OF THE INVENTION

Such lighting units are used in particular as LED lighting units in the household appliance sector, for example in washing machines and tumble dryers, dishwashers etc. To be precise, these lighting units are used in particular for lighting the working area in the household appliance, i.e. for example as a drum lighting unit in household appliances.

Such a lighting unit which is suitable for the drum of a washing machine, a tumble dryer or the like has a printed circuit board and a base for receiving the printed circuit board. A light-emitting means is arranged on the printed circuit board. It has been demonstrated that problems associated with the dissipation of the heat generated by the light-emitting means can occur. This in turn impairs the life of the lighting unit.

SUMMARY OF THE INVENTION

The invention is based on the object of developing the lighting unit such that improved heat dissipation from the light-emitting means is achieved.

In particular, on the basis of the known LED drum lighting unit, the intention is to develop a concept which substantially provides the following advantages:

improvement of the heat dissipation from the LED in order that the LED can be operated at higher current intensities, whereby in turn the luminescence efficacy can be increased;

avoidance of the relatively expensive printed circuit board used to date which has extra thick copper coating; and maintenance of compact dimensions for the lighting unit.

In the lighting unit according to the invention, the printed circuit board is arranged on a holding part in such a way that good thermally conductive contact is provided between the printed circuit board and the holding part. For its part, the holding part is fastened on the base, to be precise in particular by means of being clamped in on the base, in such a way that good heat transfer is provided from the holding part to the base. Therefore, reliable heat dissipation from the light-emitting means via the holding part and the base to the ambient air and/or to the household appliance per se is ensured, which in turn advantageously extends the life of the light-emitting means.

For the purpose of simple fastening of the printed circuit board, the holding part has a pocket at one end, into which the printed circuit board is plugged for fastening purposes. For this purpose, the pocket can expediently have a hook-shaped configuration. This is a particularly compact arrangement which is suitable for restricted installation conditions for the lighting unit in the household appliance.

In order to save on further component parts, the holding part can at the same time be used for supplying the electrical voltage for the light-emitting means. For this, electrical contact is preferably made with the printed circuit board at the pocket located at the one end. Furthermore, a plug-type connection and/or soldered joint for simple contact-making with the voltage supply, i.e. for connection to the electrical supply voltage, can be integrally formed at the other end of the holding part. Expediently, electrical contact is then made with the printed circuit board and/or the printed circuit board is mechanically fastened by means of two holding parts. For reasons of simplicity, it is an option here for the two holding parts to have a substantially identical configuration.

For protection of the light-emitting means, one option consists in a cover being positioned onto the base. The base and the cover then form a housing for the lighting unit. Expediently, a transparent protective cap can be positioned on the front side facing the printed circuit board for further protection, wherein the size of the protective cap can be matched in a flexible manner corresponding to the installation situation in the household appliance.

Preferably, the light-emitting means consists of an inexpensive and long-life light-emitting diode (LED). For reasons of simple and/or automatable installation, one option consists in soldering the light-emitting diode onto the printed circuit board as an SMD (surface mounted device) component. Furthermore, two contact pads for making electrical contact by means of the holding parts can be provided on the printed circuit board. For reasons of compactness of the lighting unit, the basic area of the printed circuit board is only insubstantially greater than that of the light-emitting means. For this, the printed circuit board has a basic area with a size which substantially corresponds to the sum of the areas of the light-emitting means and the contact pads.

It is an option for the holding part to comprise an elongate bar element. The pocket can be integrally formed at the one end of the bar element and the plug-type connection and/or soldered joint can be integrally formed at the other end of the bar element. The length of the bar element can then be matched in a flexible manner to the length of the base. The size of the base, which ultimately acts as heat sink for the lighting unit, can then in turn be determined in a simple manner corresponding to the respective requirements for the heat dissipation from the lighting unit. For reasons of a simple production process, the holding part can be in the form of a stamped and/or bent element. This results in a concept which can be matched in a very flexible manner for lighting units in different household appliances.

Good illumination of the desired area in the household appliance is often provided by virtue of the printed circuit board being arranged substantially perpendicular to the longitudinal axis of the holding part, in particular therefore perpendicular to the bar element of the holding part. If, however, the installation situation in the household appliance demands it, the printed circuit board can also be arranged at an angle to the longitudinal axis of the holding part, i.e. in particular at an angle to the bar element of the holding part.

Expediently, the holding part consists of metal, which provides good thermal conductivity between the light-emitting means and the base acting as cooling area. In an inexpensive manner, the base and/or the cover and/or the protective cap consists of a polymer. The less favorable thermal conduction of the base consisting of polymer can in this case be compensated for in a simple manner by enlarging the base, in particular in the longitudinal direction thereof. The polymer for the base and/or the cover and/or the protective cap may be a thermoplastic polymer, which makes these parts inexpensive to produce in an injection-molding process.

The following statements refer to a particularly preferred configuration of the invention. An LED lighting unit is provided in which the LED is soldered onto a small standard printed circuit board by means of an SMD process. This printed circuit board has a basic area which is only insubstantially larger than the LED itself and, in addition to the LED soldering surfaces, has only two contact pads, via which contact can be made with the printed circuit board. Contact is made via two simple stamped parts, which each have a pocket at one end, into which pocket the printed circuit board can be plugged and thus contact can be made with the printed circuit board. At the other end, the stamped parts can be shaped to form plug-type connections and/or soldered joints. In order to ensure good heat dissipation, the stamped parts are clamped between the polymer housing parts in such a way that good heat transfer from the stamped part to the housing parts can take place.

The advantages achieved by the invention consist in particular in the following:

good heat dissipation from the LED via the stamped parts and the housing parts is provided. This results in a temperature reduction at the LED of, for example, 20 K in comparison with the previous lighting unit. Owing to the improvement in the cooling effect, the housing can therefore be configured with smaller dimensions and the lighting unit can have a more compact configuration. The use of the lighting unit in household appliances at higher ambient temperatures is therefore also possible. Alternatively, the use of a more inexpensive LED with a lower junction temperature for the lighting unit is also made possible.

Simple matching to various LED types by changing the layout of the printed circuit board is enabled.

Owing to the flexible configuration options of the stamped parts, various emission directions for the heat and/or for the light from the light-emitting means can be realized corresponding to the installation conditions.

A water-tight design of the lighting unit is possible since the heat dissipation takes place by direct contact of the stamped parts with the outer wall of the housing.

The production of the lighting unit is performed by means of inexpensive standard production processes.

The lighting unit has compact external dimensions.

BRIEF DESCRIPTION OF THE DRAWINGS

Exemplary embodiments of the invention with various developments and configurations are illustrated in the drawings and will be described in more detail below.

DETAILED DESCRIPTION OF THE INVENTION

Figure 1:
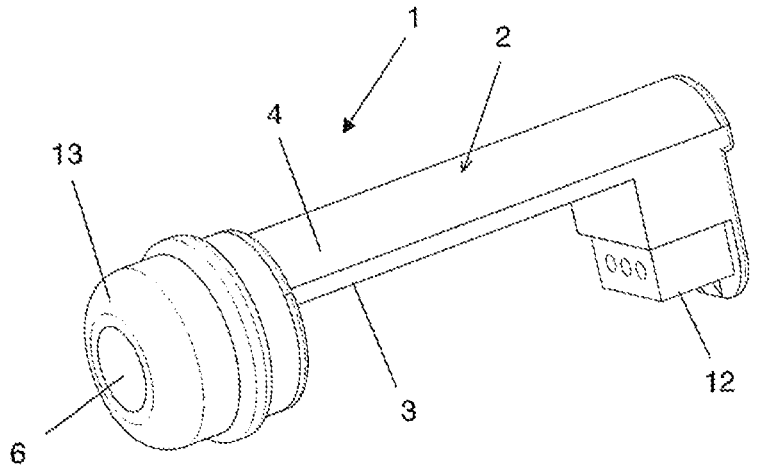
FIG. 1 shows a lighting unit in a perspective view.

FIG. 1 shows a lighting unit 1 for a household appliance. The lighting unit 1 is used, for example, as a drum lighting unit for the drum of a washing machine, a tumble dryer or the like or as a lighting unit for another working area in a household appliance. The lighting unit 1 has a housing 2, which comprises a base 3 and a cover 4. In this case, the cover 4 is positioned onto the base 3, as can be seen from FIG. 2. As can further be seen from FIG. 2, a printed circuit board 5 is located in the housing 2, wherein a light-emitting means 6 comprising a light-emitting diode (LED) is arranged on the printed circuit board 5. A cutout 7 for receiving the printed circuit board 5 is located in the front side in the base 3. Furthermore, a metallic holding part 8 is located in the housing 2. The printed circuit board 5 is arranged on the metallic holding part 8 in such a way that good thermally conductive contact is provided between the printed circuit board 5 and the holding part 8. Furthermore, the holding part 8 is fastened on the base 3, to be precise by means of the holding part 8 being clamped in in a corresponding receptacle 16 in the base 3, in such a way that good heat transfer is provided from the holding part 8 to the base 3. Thus, the lost heat produced in the light-emitting means 6 can be dissipated in a simple manner via the printed circuit board 5, the holding part 8 and the base 3, acting as cooling area, to the surrounding environment or to the household appliance housing in which the lighting unit 1 is installed. If desired, in addition a heat sink can also be arranged on the base 3 for further improving heat dissipation, but this is not shown in any further detail.

The holding part 8 has a hook-shaped pocket 9 at one end, into which pocket the printed circuit board 5 is plugged for fastening purposes. The holding part 8 at the same time is also used for supplying the electrical voltage for the light-emitting means 6. For this, the holding part 8 has, at the pocket 9, a contact pin 10, which, when the printed circuit board 5 is plugged into the pocket 9, rests on a corresponding contact pad 17 on the printed circuit board 5 for making electrical contact with the light-emitting means 6. A plug-type connection and/or soldered joint 11 for the electrical voltage supply is integrally formed at the other end of the holding part 8. In order to complete the voltage supply, the contact is made with the printed circuit board 5 by means of two holding parts 8, 8', which have a substantially identical configuration. A plug 12, which is used for connection of the lighting unit 1 to the supply voltage, can be plugged onto the plug-type connections and/or soldered joints 11 on the housing 2. The two holding parts 8, 8' also effect secure fastening of the printed circuit board 5 in the base 3. The holding part 8, 8', which comprises an elongate bar element 18, together with the pocket 9 integrally formed at the one end of the bar element 18, the contact pin 10 and the plug-type connection and/or soldered joint 11 integrally formed at the other end of the bar element 18 can be produced as a stamped and/or bent element.

Figure 2:
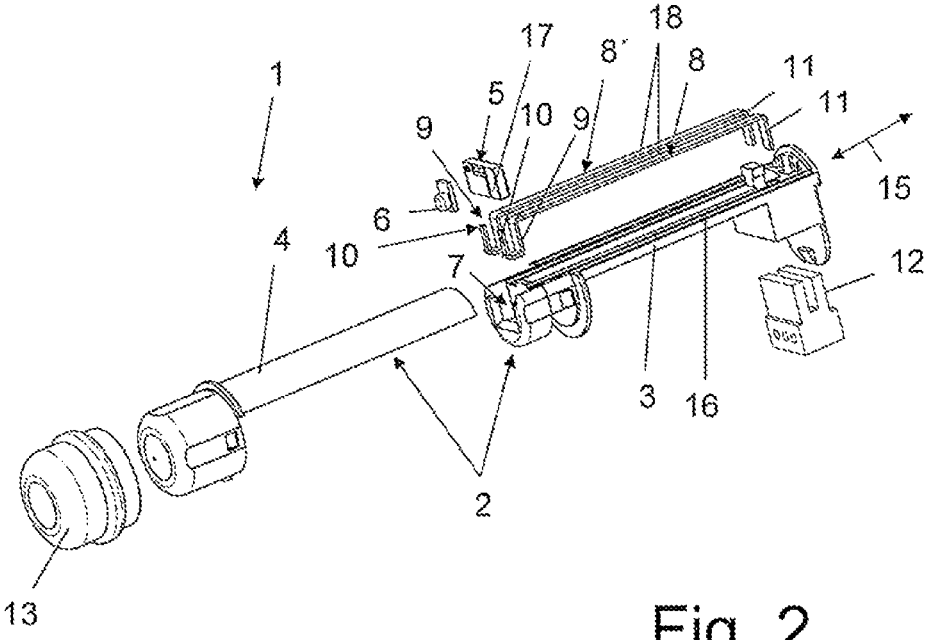
FIG. 2 shows the lighting unit shown in FIG. 1 in an exploded illustration.

The light-emitting diode 6 can be in the form of an SMD (surface mounted device) component. In this case, the light-emitting diode 6 is soldered onto the printed circuit board 5 using the SMD method. Two contact pads 17 for making electrical contact by means of the holding parts 8, 8' are provided on the printed circuit board 5, wherein only one contact pad 17 is shown in FIG. 2, however. The printed circuit board 5 then has a basic area with a size which substantially corresponds to the areas of the light-emitting diode 6 and the contact pads 17. As can be seen from FIG. 2, the basic area of the printed circuit board 5 is therefore only insubstantially larger than that of the light-emitting diode 6, which enables a very compact configuration of the lighting unit 1.

Figure 3:
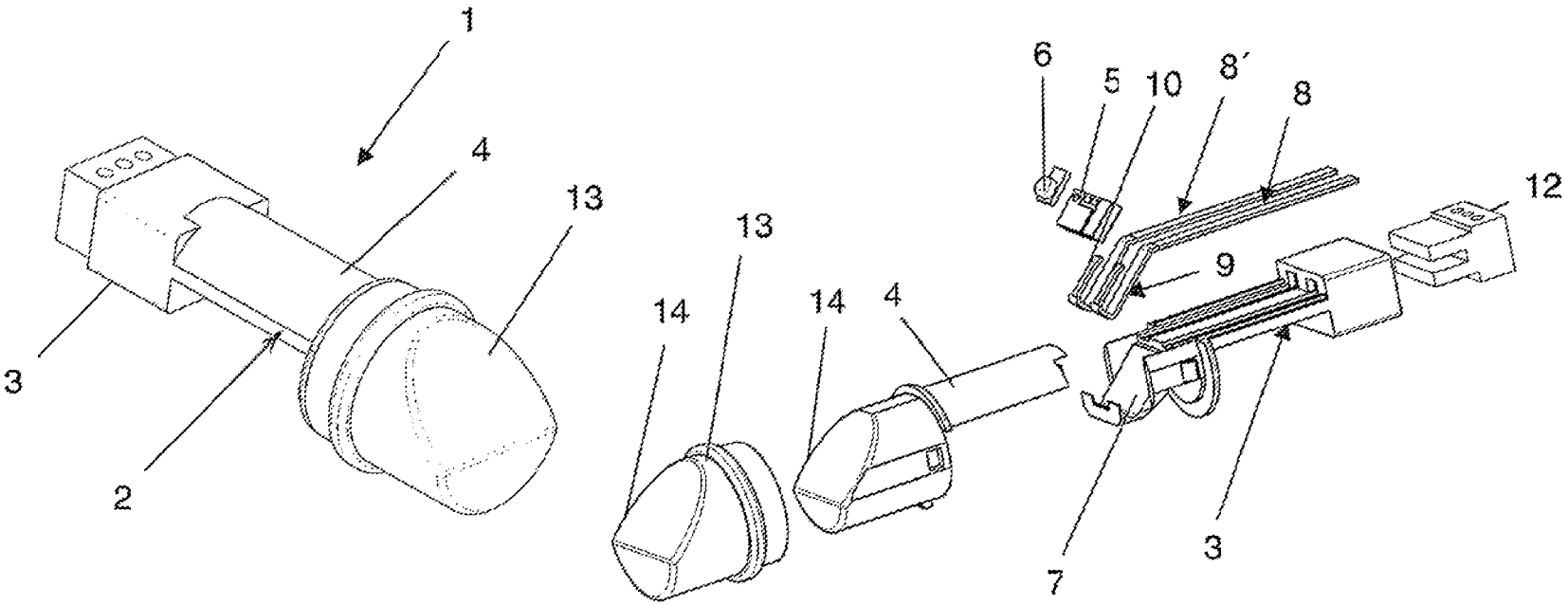
FIG. 3 shows a lighting unit corresponding to a further embodiment.

As can be seen from FIG. 2, the printed circuit board 5 is arranged substantially perpendicular to the longitudinal axis of the holding part 8, 8' or the bar element 18, wherein the longitudinal axis is denoted by the directional arrow 15. In another embodiment which is shown in FIG. 3, the printed circuit board 5 is arranged at an angle to the longitudinal axis of the holding part 8, 8' or the bar element 18. This configuration can be expedient for particular lighting unit situations in the household appliance. In this case, the cutout 7 in the base is also provided with a corresponding bevel, and the pocket 9 is arranged on the holding part 8, 8' at an angle to the longitudinal axis 15 of the holding part 8, 8'. In the embodiment shown in FIG. 3, moreover, the plug-type connection is not bent back at the holding part 8, 8' but runs along the longitudinal axis 15 of the bar element 18. In this case, the plug 12 can then be plugged onto the rear side of the housing 2, while in the embodiment shown in FIG. 2, the plug 12 can be plugged onto the housing 2 from below.

As shown in FIG. 2, a transparent protective cap 13 is positioned on the front side of the housing 2 which faces the printed circuit board 5. In the embodiment shown in FIG. 3, the protective cap 13 and/or the cover 4 are provided with beveling 14 corresponding to the angling of the printed circuit board 5. As already mentioned, the holding part 8, 8' consists of metal, to be precise of a metal with good electrical conductivity and good thermal conductivity. For example, the metal may be copper, copper-beryllium, bronze, brass or the like. The base 3, the cover 4 and the protective cap 13 consist of a polymer. Preferably, a thermoplastic polymer is used for this, with the result that these parts can be produced by means of injection molding in an inexpensive manner.

The invention is not restricted to the exemplary embodiments described and illustrated. Instead, it also includes all developments by a person skilled in the art in the context of the invention defined by the patent claims. Thus, such a lighting unit 1 can be used not only in household appliances but also in other appliances with a lighting unit.

LIST OF REFERENCE SYMBOLS

1: Lighting unit
2: Housing
3: Base
4: Cover
5: Printed circuit board
6: Light-emitting means/light-emitting diode
7: Cutout (in base)
8, 8': Holding part
9: Pocket
10: Contact pin
11: Plug-in connection and/or soldered joint
12: Plug
13: Protective cap
14: Beveling
15: Directional arrow (longitudinal axis of holding part)
16: Receptacle (in base)
17: Contact pad (on printed circuit board)
18: Bar element

The invention claimed is:

1. A lighting unit that is configured to be used for a working area in a household appliance, the lighting unit comprising: a printed circuit board comprising a light-emitting means arranged on the printed circuit board, and a base for receiving the printed circuit board, wherein the printed circuit board is arranged on a holding part, the holding part comprising an elongate bar element having a length and a predetermined width extending in a longitudinal axis direction from one end to another end of the bar element, a hook-shaped pocket having a width is integrally formed at the one end of the bar element, the hook-shaped pocket comprises a single arc portion connecting opposed portions in the length of the bar element such that the opposed portions form an axis in the hook-shaped pocket, wherein the entire width of the hook-shaped pocket is equal to or less than the predetermined width of the bar element, and the axis in the hook-shaped pocket is at an angle relative to the longitudinal axis direction of the bar element and one of a plug-type connection and a soldered joint is integrally formed at the another end of the bar element for connection to an electrical supply voltage, wherein the printed circuit board is plugged into the hooked-shaped pocket to be fastened to the holding part and to make electrical contact with the electrical supply voltage such that thermally conductive contact is provided between the printed circuit board and the holding part, and the holding part is fastened on the base by means of being clamped in on the base, in such a way that heat transfer is provided from the holding part to the base.

2. The lighting unit as claimed in claim 1, wherein two holding parts are used for supplying an electrical voltage from the electrical supply voltage to the light-emitting means arranged on the printed circuit board.

3. The lighting unit as claimed in claim 1, wherein a cover is positioned onto the base in such a way that the base and the cover form a housing for the lighting unit.

4. The lighting unit as claimed in claim 1, wherein the light-emitting means comprises a light-emitting diode, and the light-emitting diode is soldered onto the printed circuit board as an SMD (surface mounted device) component.

5. The lighting unit as claimed in claim 1, wherein two contact pads for making electrical contact by means of the holding part are provided on the printed circuit board.

6. The lighting unit as claimed in claim 1, wherein the holding part is in the form of a stamped or bent element.

7. The lighting unit as claimed in claim 1, wherein the hook-shaped pocket is integrally formed at the one end of the bar element such that the axis in the hook-shaped pocket is perpendicular to the longitudinal axis direction of the bar element.

8. The lighting unit as claimed in claim 1, wherein the holding part consists of metal, and at least one of the base, a cover and a protective cap consist of polymer.

9. The lighting unit as claimed in claim 8, wherein the polymer is a thermoplastic polymer.

10. The lighting unit as claimed in claim 1, wherein the electrical contact is made with the printed circuit board by means of two holding parts.

11. The lighting unit as claimed in claim 1, wherein the printed circuit board is fastened by means of two holding parts.

12. The lighting unit as claimed in claim 10, wherein the two holding parts have a substantially identical configuration.

13. The lighting unit as claimed in claim 11, wherein the two holding parts have a substantially identical configuration.

14. The lighting unit as claimed in claim 1, wherein a transparent protective cap is positioned on a front side of the base facing the printed circuit board.

15. The lighting unit as claimed in claim 5, wherein the printed circuit board has an area having a size which substantially corresponds to the sum of areas of the light-emitting means and the contact pads in such a way that the area of the printed circuit board is only insubstantially greater than that of the light-emitting means.

16. The lighting unit as claimed in claim 1, wherein an emission direction for light from the light-emitting means is arranged on the printed circuit board, such that the emission direction of the light from the light-emitting means is emitted out of the lighting unit at the angle of the axis in the hook-shaped pocket relative to the longitudinal axis direction of the bar element.

* * * * *